US007135947B2

(12) United States Patent
Engel

(10) Patent No.: US 7,135,947 B2
(45) Date of Patent: Nov. 14, 2006

(54) HYBRID MICROWAVE T-SWITCH ACTUATOR

(75) Inventor: Klaus Gunter Engel, Waterloo (CA)

(73) Assignee: Com Dev Ltd., Cambridge (CA)

( * ) Notice: Subject to any disclaimer, the term of this patent is extended or adjusted under 35 U.S.C. 154(b) by 115 days.

(21) Appl. No.: 10/765,944

(22) Filed: Jan. 29, 2004

(65) Prior Publication Data

US 2005/0168309 A1 Aug. 4, 2005

(51) Int. Cl.
*H01H 67/02* (2006.01)

(52) U.S. Cl. ..... 335/128; 335/229

(58) Field of Classification Search ..... 335/128, 335/220–229

See application file for complete search history.

(56) References Cited

U.S. PATENT DOCUMENTS

| | | | | |
|---|---|---|---|---|
| 3,513,341 | A | 5/1970 | Gratzmuller | |
| 3,959,672 | A * | 5/1976 | Walker et al. | 310/36 |
| 4,388,545 | A * | 6/1983 | Honsinger et al. | 310/156.66 |
| 4,520,331 | A | 5/1985 | Steidel | |
| 4,899,073 | A | 2/1990 | Takeuchi et al. | |
| 5,063,364 | A | 11/1991 | Tsoi | |
| 5,065,125 | A | 11/1991 | Thomson et al. | |
| 5,281,936 | A | 1/1994 | Ciezarek | |
| 5,499,006 | A | 3/1996 | Engel et al. | |
| 5,936,482 | A | 8/1999 | Ando et al. | |
| 5,952,902 | A | 9/1999 | Kich et al. | |
| 6,020,804 | A | 2/2000 | Gandel | |
| 6,037,849 | A | 3/2000 | Ciezarek | |
| 6,737,784 | B1 * | 5/2004 | Lindquist et al. | 310/216 |
| 2002/0125780 | A1 * | 9/2002 | Shiratori | 310/156.21 |

FOREIGN PATENT DOCUMENTS

| | | |
|---|---|---|
| DE | 35 24 713 A1 | 1/1987 |
| FR | 825 414 A | 3/1938 |
| WO | WO 03 100944 A1 | 12/2003 |

* cited by examiner

*Primary Examiner*—Elvin G. Enad
*Assistant Examiner*—Bernard Rojas
(74) *Attorney, Agent, or Firm*—Bereskin & Parr; Isis E. Caulder

(57) ABSTRACT

A hybrid switch actuator having six positions that are stable in the absence of current and in which displacement occurs between an initial position and a target position under the action of a current. The actuator includes a stator and a rotationally moveable rotor package. The stator has six pole shoes. Each pair of opposed pole shoes is equipped with a common exciting coil. The rotor package has two pairs of rotor poles magnetized transversely in alternate directions and a permanent magnet ring and two end caps adapted to be engaged around said permanent magnet ring. Each end cap is associated with two rotor poles having maximum radius regions that correspond to the area of each of the stator pole shoes and reduced radius regions positioned adjacent the maximum radius regions such that each rotor pole can be precisely aligned with each stator pole shoe.

8 Claims, 9 Drawing Sheets

HYBRID MICROWAVE T-SWITCH ACTUATOR

FIELD OF THE INVENTION

This invention relates to microwave switch actuators and more particularly to an actuator for a microwave T-switch that uses permanent magnetic and switch reluctance techniques.

BACKGROUND OF THE INVENTION

Microwave T-switches are amongst the most common embodiments of coaxial radio frequency (rf) switching devices in communication satellite applications. Microwave T-switches are typically of small size and volume and are well adapted for satellite communication applications that have constrained mass and volume satellite payloads. Conventional rotary coaxial T-switches such as those disclosed in U.S. Pat. Nos. 5,065,125 and 5,063,364 have switch states that are selectable by driving a cam disc to various predetermined angular positions. Actuation means are used to rotate the cam disc within a coaxial microwave switch to the desired angular position and typically utilize either permanent magnet devices or switched reluctance devices.

Permanent magnet devices resemble brushless dc motors and are doubly excited devices in which magnetic flux is generated by a driven coil on the stationary part and a permanent magnet on the moving part. Force is developed through the mutual flux linkages. Generally, permanent magnet devices utilize a relatively large proportion of magnetic material that substantially increases the mass and volume of the actuator. Permanent magnet actuators exhibit residual torque properties, which tend to hold the actuator in preferred locations when un-powered. These effects, which are due to the influences of the magnets, must be overcome when applying power to achieve a new position thereby diminishing the ultimate performance of the actuator. While this un-powered holding torque may be exploited to latch the mechanism between actuations, this is not required in the T-switch application because the load provides sufficient latching torque and the un-powered torque becomes a parasitic effect. The application requirement that the actuator have a well defined, precise target displacement (i.e., a power on equilibrium point where the mechanism comes to rest in the desired location) only serves to exacerbate this parasitic effect.

Switched reluctance devices are singly excited devices with a driven coil on the stationary part and soft ferromagnetic material on the moving part. Force is developed as the moving part tends towards an orientation in which the magnetic circuit reluctance is minimum. Such singly excited actuators have zero un-powered torque. However, because operating torque is related to the change in reluctance with respect to angular displacement, and because there is a finite total change in reluctance possible with available materials and fabrication methods, such actuators only operate efficiently where small angular displacements are required. Since the conventional microwave T-switch requires 60° displacement variable, reluctance actuators are not appropriate for use.

SUMMARY OF THE INVENTION

The invention provides in one aspect, a hybrid switch actuator having six positions that are stable in the absence of current and in which displacement occurs between an initial position and a target position under the action of a current, for operation of a microwave switch, said actuator comprising:

(a) a stator having six pole shoes, each pair of opposed pole shoes being associated with a common exciting coil;

(b) a rotor package rotatable along a rotation axis and adapted to be positioned within said stator and having two pairs of rotor poles magnetized transversely in alternate directions, said rotor package including:

(i) a permanent magnet ring magnetized along the rotation axis;

(ii) two end caps adapted to be engaged around said permanent magnet ring, each end cap having two maximum radius regions that each correspond to the area of each of the stator pole shoes;

(c) such that when two diametrically opposed stator pole shoes having a first polarity are excited through their associated common exciting coil, said stator pole shoes attract two diametrically opposed rotor poles having an opposite polarity to said first polarity and repel the remaining two rotor poles such that each rotor pole associated with a maximum radius region can be precisely aligned with a stator pole associated with a stator pole shoe.

Further aspects and advantages of the invention will appear from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show some examples of the present invention, and in which.

Figure 1:
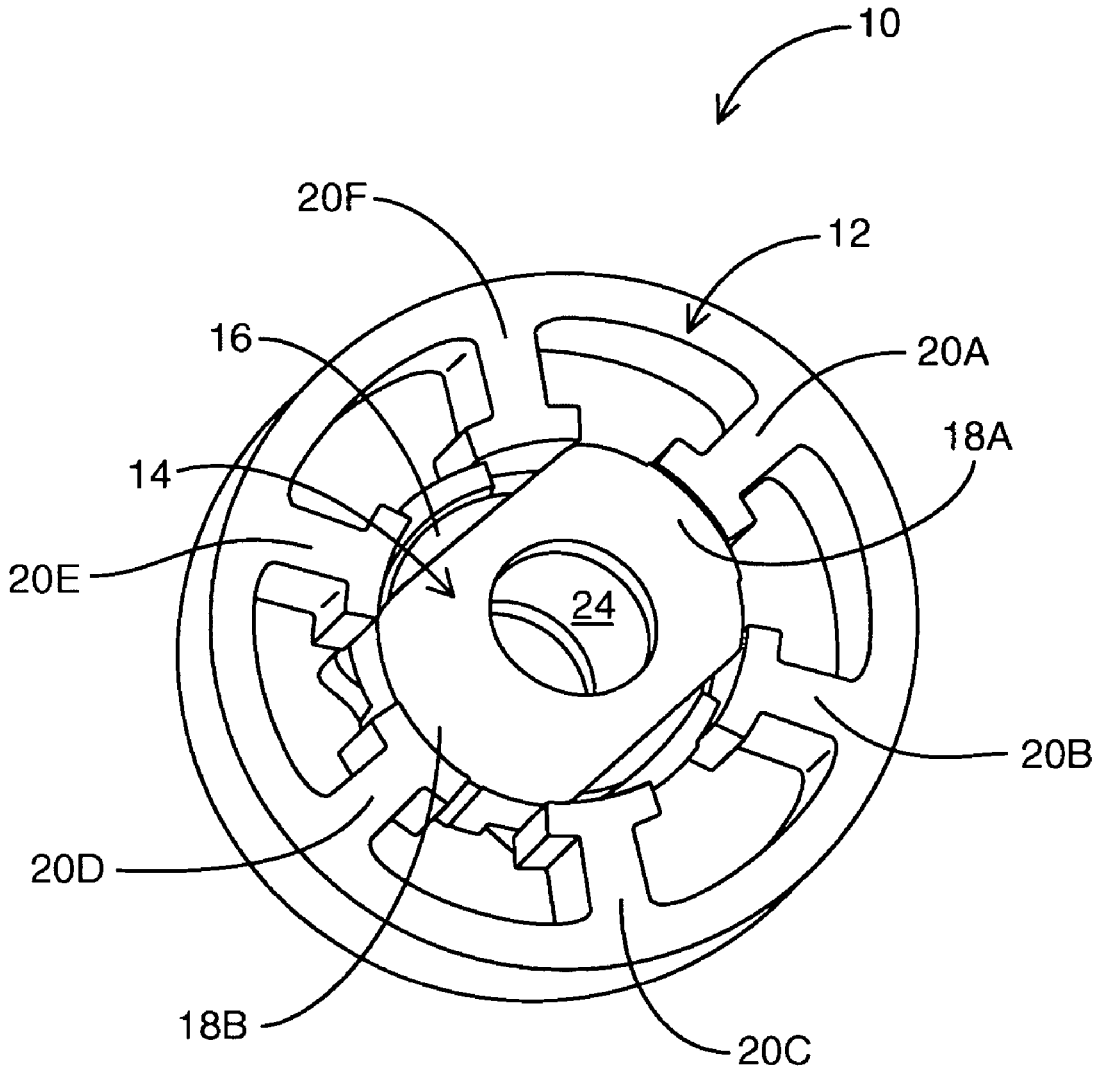
FIG. 1 is a perspective view from the top of the hybrid T-switch actuator of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

Figure 2A:
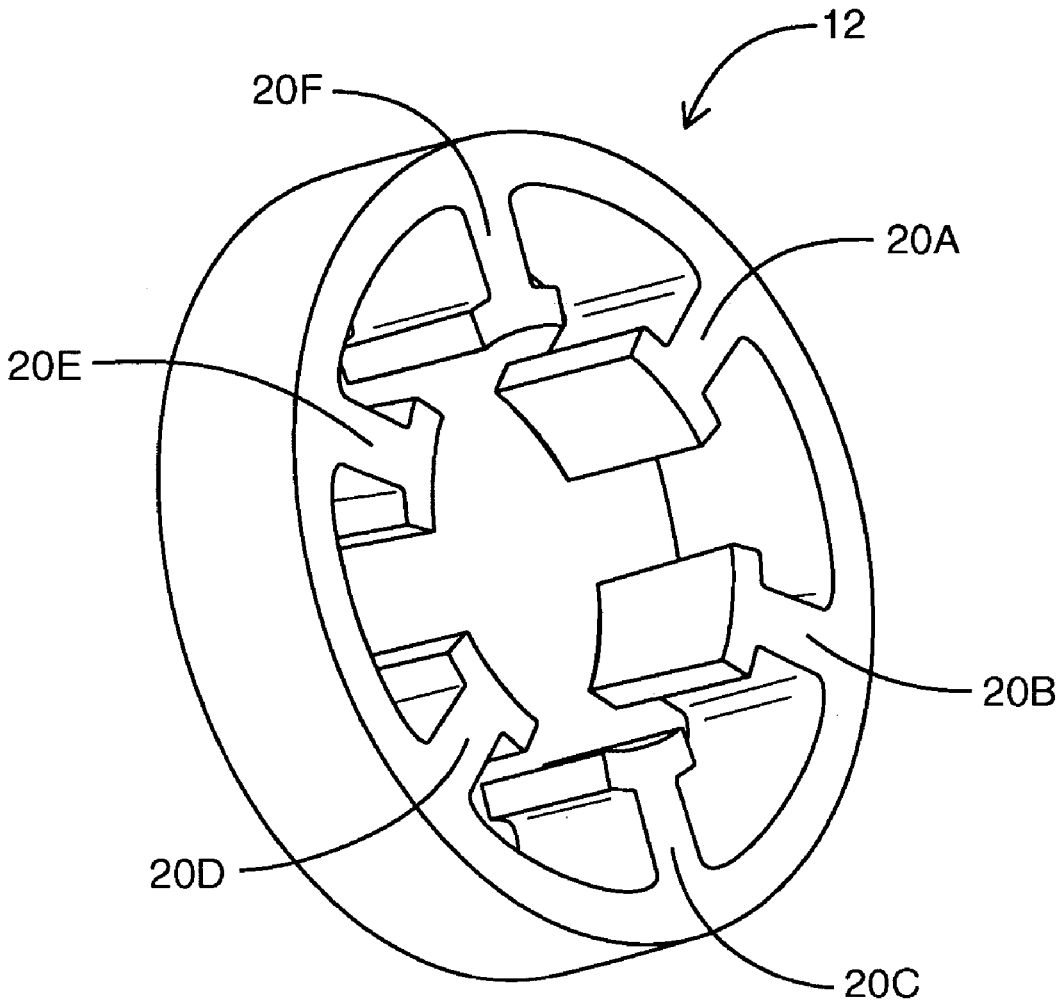
FIG. 2A is a side perspective view of the stator of the actuator of FIG. 1.
Figure 2B:
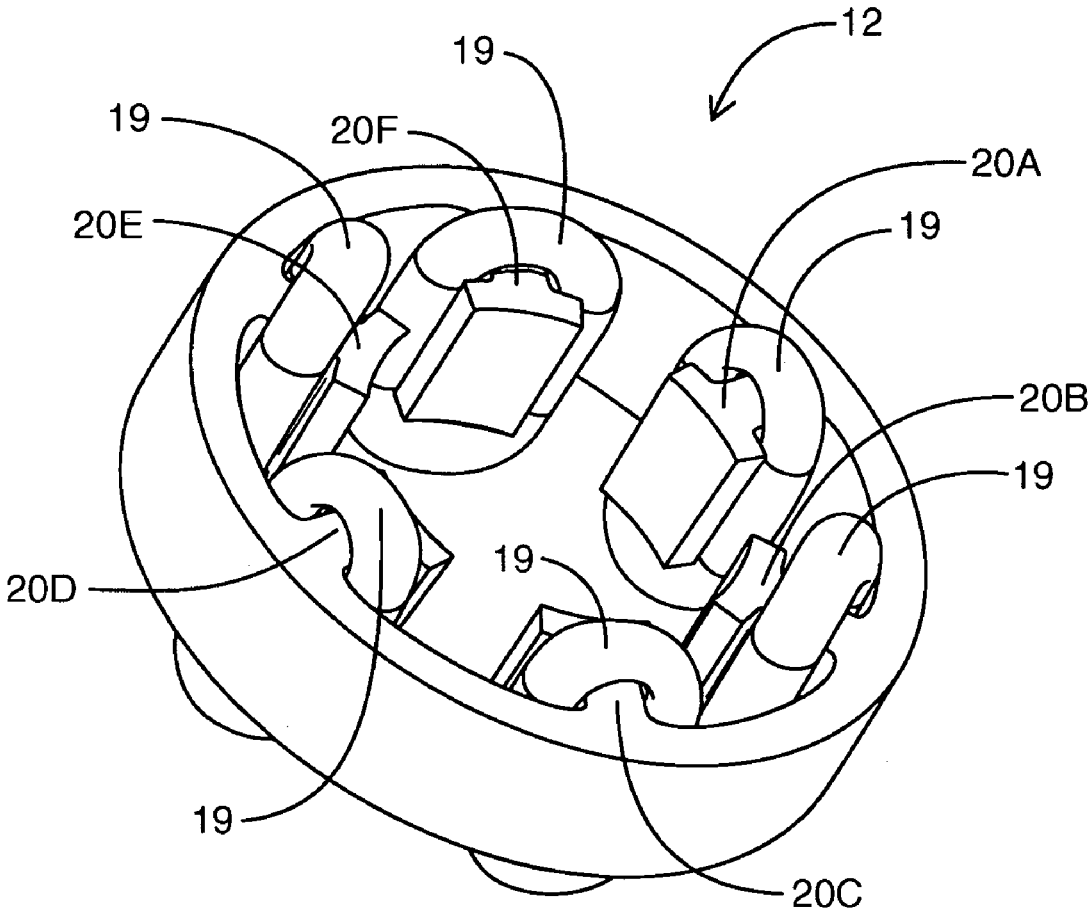
FIG. 2B is a side perspective view of the stator of the actuator of FIG. 1 with winding coils installed on the pole shoes of stator.

FIGS. 1, 2A, 2B, 3A, 3B and 3C illustrate a hybrid T-switch actuator 10 built in accordance with the present invention. Specifically, actuator 10 includes a stator 12 and a rotor package 14. Stator 12 has six discrete inward-facing pole shoes 20A, 20B, 20C, 20D, 20E, 20F (FIGS. 2A and 2B) on which are wound excitation coil windings 19 (FIG. 2B). Rotor package 14 includes a permanent magnet 16 and two end caps 18 and 22 (FIGS. 1, 3A, 3B, 3C). Rotor package 14 has four poles 18A, 18B, 22A, and 22B magnetized transversely in alternate directions with alternating north/south bias 90° apart. Actuator 10 combines the use of ferrous poles with varying reluctance in stator 12 with permanent magnet 16 within the magnetic circuit of rotor package 14 to magnetically bias the stator poles and improve the efficiency of the ferrous material. During operation, two diametrically opposed stator poles are excited through a common coil that simultaneously attracts two rotor poles having unlike polarity and repels the remaining two rotor poles to cause rotor package 14 to move from an initial to a target position, as will be described.

Stator 12 has six discrete pole shoes 20A, 20B, 20C, 20D, 20E and 20F facing inwards (FIGS. 2A and 2B). Excitation coil windings 19 are wound in three independent phases on the pole shoes 20A, 20B, 20C, 20D, 20E, 20F of stator 12 such that there are three common excitation coil pairs. Each phase consists of an excitation coil 19 connected in series with the excitation coil diametrically opposite (e.g. the excitation coils associated with pole shoes 20A and 20D or pole shoes 20B and 20E). All excitation coils 19 have the same magnetic sense. That is, all excitation coils 19 are oriented radially inwards or all radially outward. Stator 12 is preferably made of soft (i.e. low coercivity) ferrous material and the excitation windings 19 are preferably made of copper.

Figure 3A:
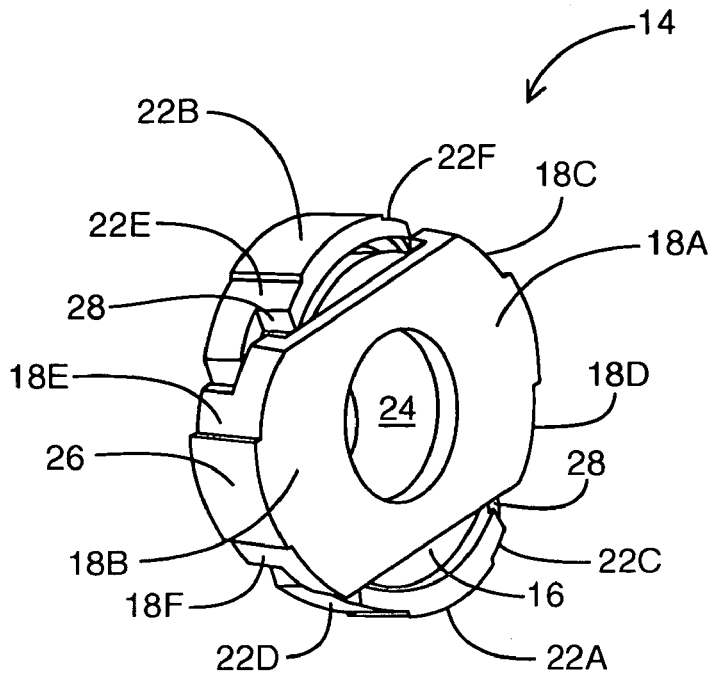
FIG. 3A is a side perspective view of the rotor package of the actuator of FIG. 1.
Figure 3B:
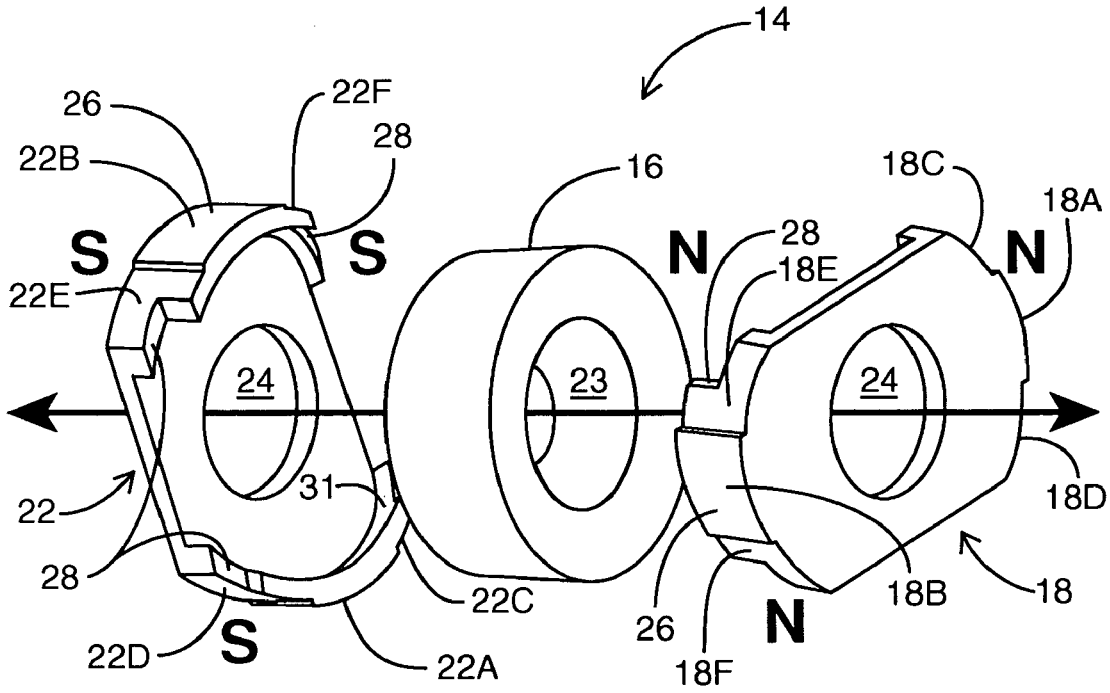
FIG. 3B is an exploded side perspective view of the rotor package of the actuator of FIG. 1.
Figure 3C:
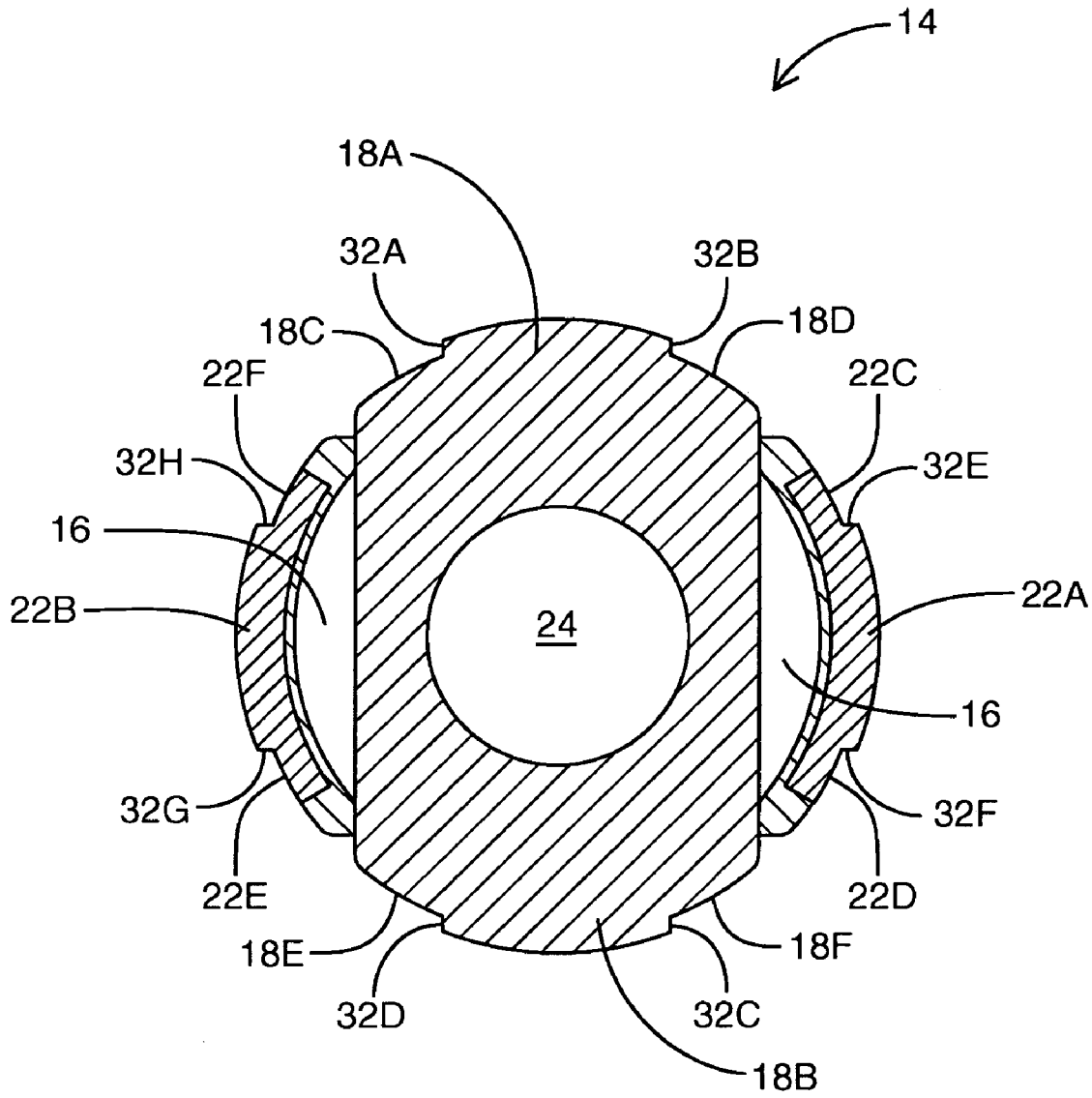
FIG. 3C is a top view of the rotor package of the actuator of FIG. 1.

Rotor package 14 is adapted to be rotationally movable within stator 12 and includes a permanent magnet 16 and two end caps 18 and 22 (FIGS. 3A, 3B and 3C). Each end cap 18 and 22 is associated with two poles 18A, 18B and 22A and 22B, respectively. Accordingly, rotor package 14 has four magnetic poles 18A, 18B, 22A and 22B that are each spaced 90° apart and have alternating north/south bias. Each pole 18A, 18B, 22A, and 22B is adapted to be selectively attracted to or repelled a different stator pole 20A, 20B, 20C, 20D, 20E, 20F of stator 12.

Figure 5:
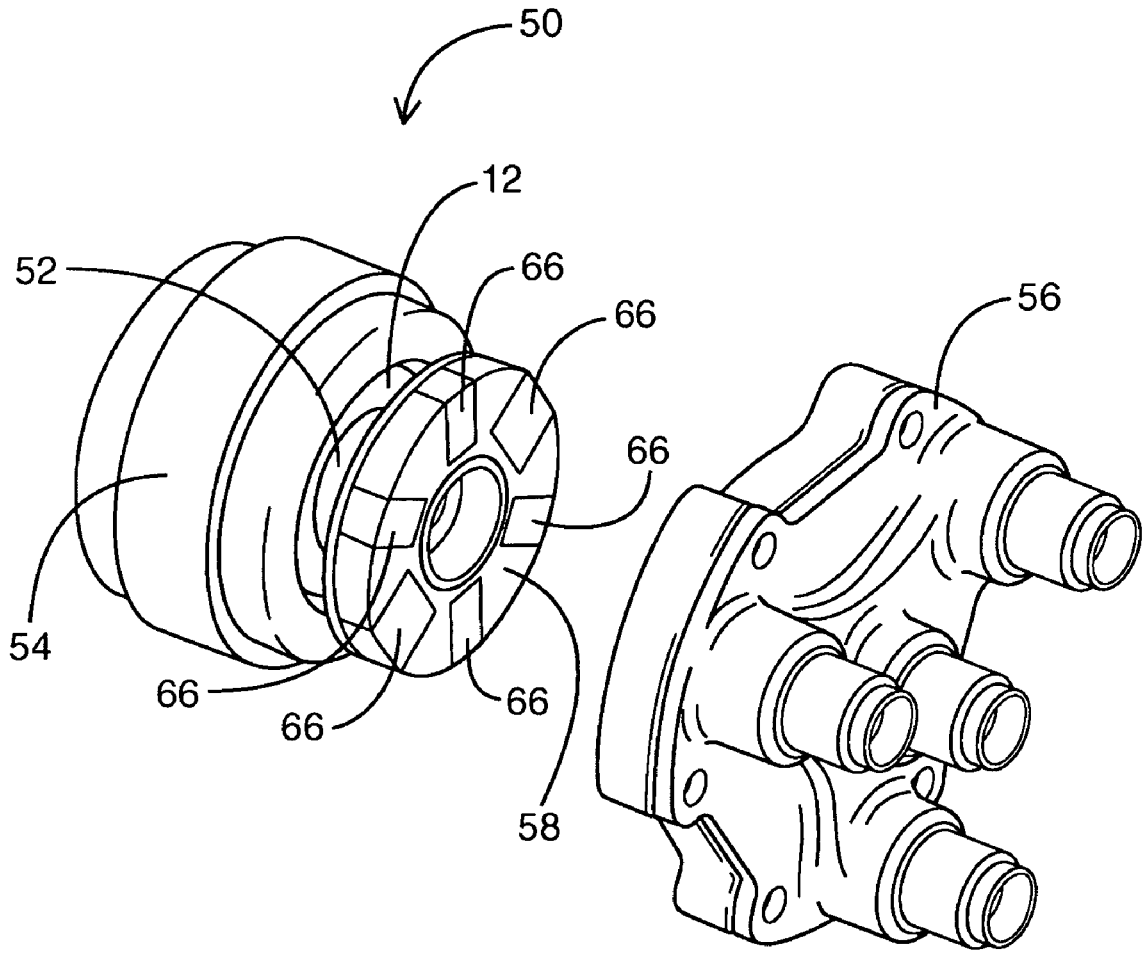
FIG. 5 is a side perspective view of the actuator of FIG. 1 implemented within a conventional T-switch.

Permanent magnet 16 is a thick ring of permanently magnetized material that is magnetized parallel to the rotation axis as shown in FIG. 3B. For illustrative purposes, it will be assumed that the top part of permanent magnet 16 is magnetized NORTH and the bottom part of permanent magnet 16 is magnetized SOUTH as shown in FIG. 3B. However, it should be understood that permanent magnet 16 could be of opposite polarity (i.e. top SOUTH and bottom NORTH). Permanent magnet 16 has an orifice 23 that is sized to receive a shaft 52 (FIG. 5) that serves to support the rotor package 14 and to deliver actuator torque to a microwave T-switch 50 (FIG. 5).

Permanent magnet 16 is preferably manufactured to have a thickness in the range of 5 to 8 mm but can also be in the range of 4 to 12 mm. Also, permanent magnet preferably has a diameter in the range of 12 to 15 mm but can also be in the range of 9 to 20 mm. Although it is preferable for the outer perimeter of permanent magnet 16 to be circular, the outer perimeter of permanent magnet 16 could also be of a square or other polygonal shape. Permanent magnet 16 is preferably constructed by magnetizing a disk of a rare earth alloy such as samarium cobalt, however any other material used for the construction of permanent magnets could be utilized. In the preferred embodiment, a sintered samarium cobalt material having remanence of one Tesla and specific energy product of 200,000 Tesla-Ampere/meter is utilized, End caps 18 and 22 are constructed to contact and fit around permanent magnet 16 as shown in FIGS. 3A, 3B and 3C. Each end cap 18 contains an orifice 24 that is sized to correspond to the orifice 23 of permanent magnet 16. End caps 18 and 22 have flanges 26 with stepped edges 28 and undersides 31 that are formed to fit around permanent magnet 16 so that end caps 18 and 22 can each engage permanent magnet 16 while avoiding direct contact with each other as will be described. Flanges 26 have an outer surfaces that includes slightly indented regions 18C, 18D, 18E, 18F, 22C, 22D, 22E, 22F as shown.

Accordingly, end cap 18 contains two maximum radius regions 18A and 18B, each having two adjoining reduced radius regions on either side. Specifically, maximum radius region 18A has two adjoining regions of lesser radius 18C and 18D and maximum radius region 18B has two adjoining reduced radius regions 18E and 18F. End cap 22 contains two maximum radius regions 22A and 22B each also having two adjoining reduced radius regions on each side. That is maximum radius region 22A has two adjoining reduced radius regions 22C and 22D. Maximum radius region 22B has two adjoining reduced radius regions 22E and 22F. End caps 18 are preferably manufactured out of a soft ferrous material (i.e. a ferromagnetic material having high permeability and low coercivity).

The undersides 31 of flanges 26 of end caps 18 and 22 are intimately coupled to the outer surface of permanent magnet 16 such that magnetic flux from permanent magnet 16 is conducted by the ferrous material of end caps 18 and 22 outward towards the maximum radius regions 18A, 18B, 22A, and 22B as well as to the reduced radius regions 18C, 18D, 18E, 18F, 22C, 22D, 22E, and 22F. Flanges 26 and step edges 28 of flanges 26 are of a magnetic potential similar to the maximum radius regions of end caps 18 and 22. Accordingly, flanges 26 and step edges 28 of flanges 26 act as magnetic poles since they present magnetically charged surfaces positioned to interact strongly with nearby pole shoes 20A, 20B, 20C, 20D, 20E and 20F of stator 12. End caps 18 and 22 are designed for assembly in a complimentary fashion, as shown in FIG. 3A, but are designed such that a separation of at least 1.5 mm is maintained between any and all elements of end caps 18 and 22. This separation minimizes the direct leakage of flux from the NORTH pole to the SOUTH pole of permanent magnet 16 through the end caps 18 and 22.

When assembled, rotor package 14 contains rotor poles associated with maximum radius regions 18A, 18B, 22A, 22B. Assuming the illustrative polarity of permanent magnet 16 discussed above, the NORTH polarity of permanent magnet 16 extends for 360° along its top surface and the SOUTH polarity of permanent magnet 16 extends for 360° along its bottom surface. Accordingly, two poles having the same polarity (NORTH) are generated at the two maximum radius regions 18A and 18B of end cap 18 (FIG. 3B). Also, two poles of the same polarity (SOUTH) are generated at the two maximum radius regions 22A and 22B of end cap 22 (FIG. 3B). Accordingly, the four rotor poles associated with rotor package 14 have alternating north/south bias as shown in FIG. 3B.

As shown in FIG. 3C, when assembled, rotor package 14 includes eight shoulders 32A, 32B, 32C, 32D, 32E, 32F, 32G, and 32H each located on one side of the four maximum radius regions 18A, 18B, 22A, 22B and delineating a transition from the maximum radius regions 18A, 18B, 22A, 22B to the adjoining reduced radius regions 18C, 18D, 18E, 18F, 22C, 22D, 22E, 22F. Shoulders 32A, 32B, 32C, 32D, 32E, 32F, 32G, 32H and the reduced radius regions 18C, 18D, 18E, 18F, 22C, 22D, 22E, 22F are used within actuator 10 to blend the change in reluctance with displacement over a larger angle which in turn permits actuator 10 to "pull-in" from the large displacement of 60° as will be described.

The area and the magnitude of the recess associated with shoulders 32A, 32B, 32C, 32D, 32E, 32F, 32G, 32H can be considered design variables which can be optimized to match the torque of actuator 10 to the complex reaction loads of the switch rf module. In this manner, each of the four magnetic poles associated with the maximum radius regions 18A, 18B, 22A, 22B, within rotor package 14 has a central area (i.e. a maximum radius region) that is capable of approaching the pole shoes of stator 12 more closely than the surrounding areas of the rotating package poles when rotor and stator poles align. The magnitude of separation between rotating and stationary poles, combined with the surface areas of the aligned portions of the poles determine the reluctance of the magnetic flux path between the poles. The magnitude of the radius difference between the maximum radius region and the reduced radius region is typically 0.05 mm to 0.10 mm, but it should be understood that this difference could be selected to suit the application.

Accordingly, rotor package 14 utilizes a "shaded pole" construction for operation. That is, end caps 18 and 22 provide rotor package 14 with four rotor poles at the maximum radius regions 18A, 18B, 22A, 22B magnetized transversely in alternate directions. Each rotor pole is associated with a maximum radius region and sized to correspond to the area of each stator pole shoe 20A, 20B, 20C, 20D, 20E, 20F. Accordingly, the rotor poles associated with the maximum radius regions 18A, 18B, 22A, 22B can be precisely aligned with the stator poles associated with the stator pole shoes 20A, 20B, 20C, 20D, 20E, 20F. In addition, shoulders 32A, 32B, 32C, 32D, 32E, 32F, 32G, 32H and reduced radius regions 18C, 18D, 18E, 18F, 22C, 22D, 22E, 22F are used within actuator 10 to blend the change in reluctance with displacement over a larger angle which in turn permits actuator 10 to "pull-in" from the large displacement of 60°.

Since rotary actuator 10 employs variable reluctance principles to converge positively and precisely to a defined target location, the rotor pole must subtend an arc similar in magnitude to the arc subtended by the stator pole in order that the condition of exact alignment defines an unique and minimum reluctance value. Limiting the expanse of the rotor pole in this way also limits the angle over which the rotor pole can effect magnetic influence, restricting the operation to small angle steps. Incorporating the outlying regions of reduced radius expands the arc of operability, while maintaining a condition on minimum reluctance when the central part of the rotor pole is aligned with the stator pole.

Figure 4A:
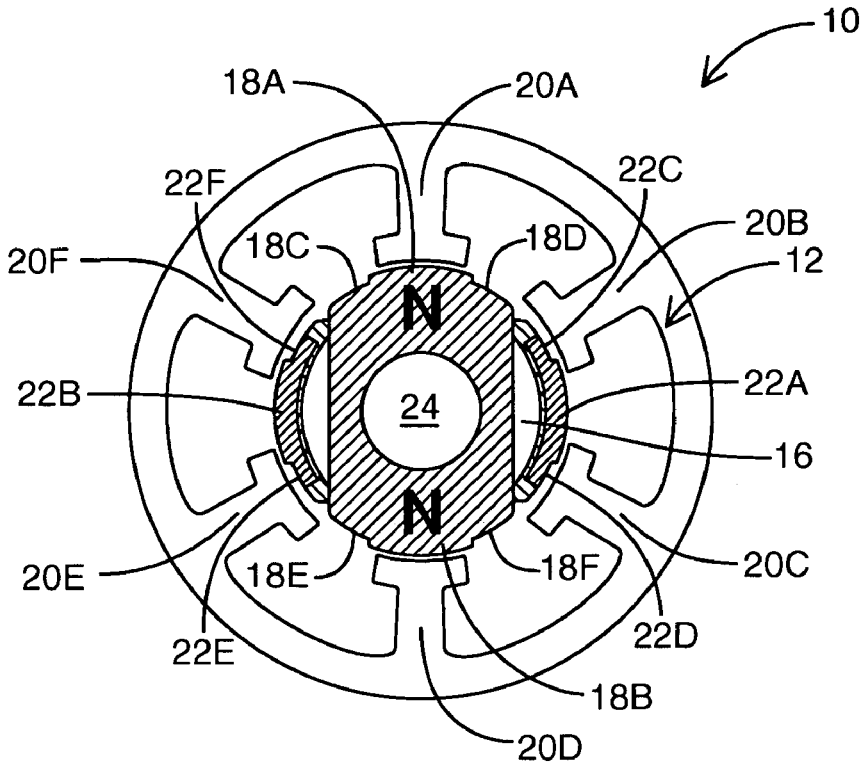
FIG. 4A is a top view of the actuator of FIG. 1 in a first position.
Figure 4B:
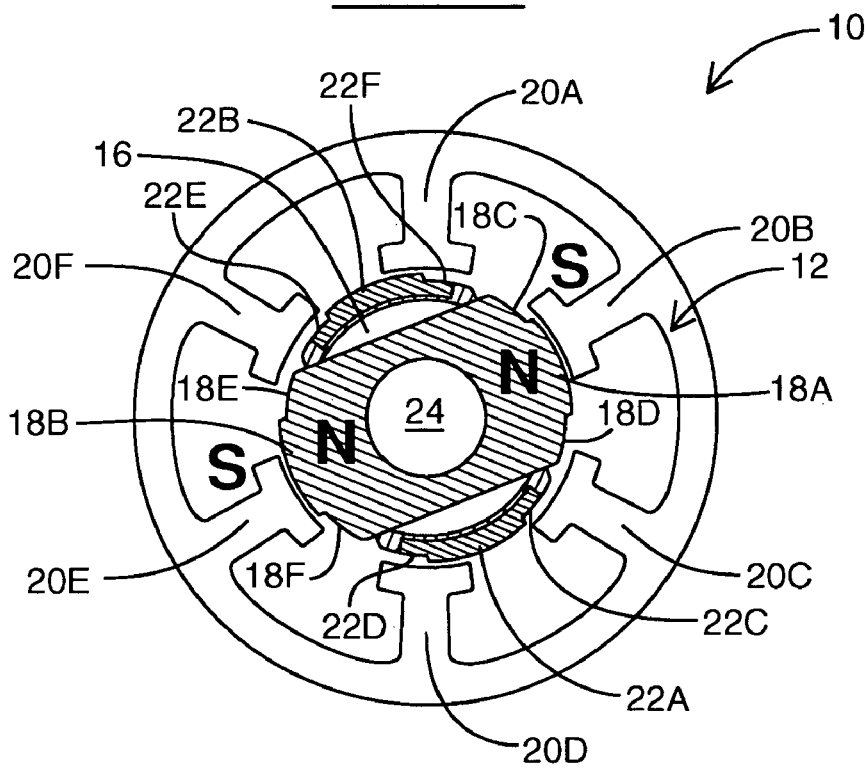
FIG. 4B is a top view of the actuator of FIG. 1 in a second position.

Now referring to FIGS. 1, 4A, 4B, and 4C, the general operation of actuator 10 will be discussed. FIG. 4A shows actuator 10 in a first position (i.e. an initial position) that is stable in the absence of current. It is necessary to apply a significant torque to displace rotor package 14 from the first position into the second position (i.e. target position) as shown in FIG. 4B. Movement from the first position to the second position is achieved by applying a current pulse to actuator 10 and energizing two oppositely positioned excitation coil windings 19 (FIG. 2B) of stator 12 associated with pole shoes 20B and 20E such that a SOUTH polarity is generated at pole shoes 20B and 20E. Since the two rotor poles associated with the maximum radius regions 18A and 18B and reduced radius regions 18C, 18D, 18E, and 18F have a polarity (NORTH) that is opposite to the polarity of pole shoes 20B and 20E, the two rotor poles associated with the maximum radius regions 18A and 18B and reduced radius regions 18C, 18D, 18E, 18F are attracted to the excited stator pole shoes 20B and 20E, respectively. The two remaining rotor poles positioned 90° away from 18A and 18B, namely rotor poles 22A and 22B and reduced radius regions 22C, 22D are simultaneously repelled from the excited stator pole shoes 20B and 20E since they have a polarity (SOUTH) that is the same as the polarity of the pole shoes 20B and 20E.

As rotor package 14 moves within stator 12 from the first position (FIG. 4A) to the second position (FIG. 4B), at the commencement of motion, the reduced radius regions 18D and 18E of the rotor pole are in close proximity to the energized stator pole shoes 20B and 20E which affords a strong initial torque even though the rotor is 60° removed from the target position. As motion continues, the reduced radius regions 18D and 18E overlap the stator pole shoes 20B and 20E, progressively reducing the reluctance through the gap between the rotating and stationary poles and enhancing the torque output by means of the varying reluctance principal. When the reduced radius regions 18D and 18E fully overlap the stator poles 20B and 20E and no further reluctance reduction is possible for a reduced radius pole, the maximum radius regions 18A, 18B of the rotor poles, begin to overlap the stator pole shoes 20B and 20E beginning a segment of further reluctance reduction and further torque enhancement as the area of minimum pole separation increases. The cycle ends at a stable and well defined equilibrium when the magnetic rotor poles associated with maximum radius regions 18A and 18B are aligned with the oppositely polarized stator pole shoes 20B and 20E in the minimum reluctance state.

Figure 4C:
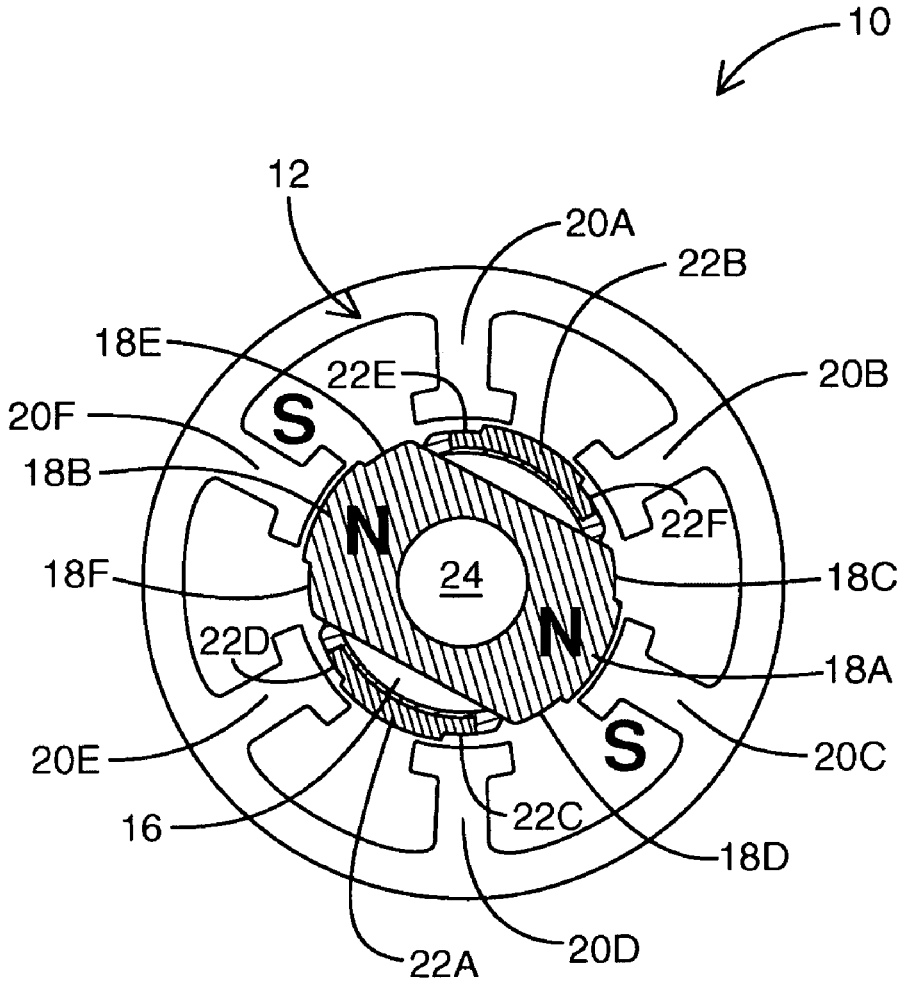
FIG. 4C is a top view of the actuator of FIG. 1 in a third position.

Starting in the second position (FIG. 4B), it will now be illustrated how actuator 10 moves from a second position (i.e. another initial position) to a third position (i.e. another target position) shown in FIG. 4C. It is again necessary to apply a significant torque to displace rotor package 14 from the second position (FIG. 4B) into the third position (FIG. 4C). Movement from the second position to the third position is achieved by again applying a current pulse to actuator 10 and energizing two oppositely positioned excitation coil windings 19 of stator 12 associated with pole shoes 20C and 20F such that a SOUTH polarity is generated at pole shoes 20C and 20F. Since the two rotor poles associated with the maximum radius regions 18A and 18B and reduced radius regions 18C, 18D, 18E, and 18F have a polarity (NORTH) that is now opposite to the polarity of pole shoes 20C and 20F, the two rotor poles associated with the maximum radius regions 18A and 18B and reduced radius regions 18C, 18D, 18E, and 18F are attracted to the excited stator pole shoes 20C and 20F, respectively. Simultaneously, the two remaining rotor poles positioned 90° away from 18A and 18B, namely rotor poles associated with maximum radius regions 22A and 22B and reduced radius regions 22C, 22D, 22E and 22F are simultaneously repelled from the excited stator pole shoes 20C and 20F.

As rotor package 14 moves within stator 12 from the second position (FIG. 4B) to the third position (FIG. 4C), at the commencement of motion, the reduced radius regions 18D and 18E of the rotor pole are in close proximity to the energized stator poles 20C and 20F which affords a strong initial torque even though the rotor is 60° removed from the target position. As motion continues, the reduced radius regions 18D and 18E overlap the poles associated with stator pole shoes 20C and 20F progressively reducing the reluctance through the gap between the rotating and stationary poles and enhancing the torque output by means of the varying reluctance principal. When the reduced radius regions 18D and 18E fully overlap the stator poles associated with pole shoes 20C and 20F and no further reluctance reduction is possible for a reduced radius pole, the maximum radius regions 18A, 18B of the rotor poles, begin to overlap the stator poles associated with pole shoes 20C and 20F beginning a segment of further reluctance reduction and further torque enhancement as the area of minimum pole separation increases. The cycle ends at a stable and well defined equilibrium when the magnetic rotor poles are aligned with the oppositely polarized stator poles and specifically when the maximum radius regions 18A, 18B of the rotor poles are precisely aligned with the stator poles associated with pole shoes 20C and 20F in the minimum reluctance state. Accordingly, actuator 10 moves from the second position to the third position shown in FIG. 4B.

As shown in FIG. 5, actuator 10 is used to actuate a conventional microwave T-switch 50. Actuator 10 provides improved switching behavior within microwave T-switch 50 due to the fact that actuator 10 exploits the bilateral symmetry of microwave T-switch 50. Stator 12 (not shown) is supported in a housing 54 and rotor package 14 is supported on a shaft 52. Shaft 52 is itself supported on ball bearings (not shown). One end of shaft 52 extends to form a broad disc 58 that supports six magnets 66 that face the rf module 56. The six magnets 66 include two magnets that present one pole (e.g. NORTH) to the rf module 56 and four magnets presenting the opposite pole (i.e. SOUTH) to rf module 56. Within the rf module 56 there are six electric contacts (not shown) each incorporating a magnet, all facing the actuator with the same polarity. These electric contacts provide multiple signal routing possibilities among the four rf interface connectors seen on the rf module. The electric contact magnets are approximately on a pitch circle similar to that of the actuator "magnetic cam".

When actuator 10 is rotated in steps of 60°, corresponding magnets are aligned in such a way that in any standard position, two rf circuits are closed and four are open. The cam magnet 66 arrangement is symmetric (i.e. the two NORTH magnets are positioned diametrically opposite to each other) such that the pattern repeats every 180°. As is conventionally known, microwave T-switch 50 is bilaterally symmetric and has three selectable positions each separated by 60° and after 180°, the pattern is repeated. It can be seen that actuator 10 exploits the full 360° range of motion and will always follow the shortest trajectory to the target position that will never exceed 60°. Typically, permanent magnet actuators are required to move 120° in some situations. Accordingly, actuator 10 can provide T-switch 50 with superior switching speed while being of lower mass and volume.

Figure 6:
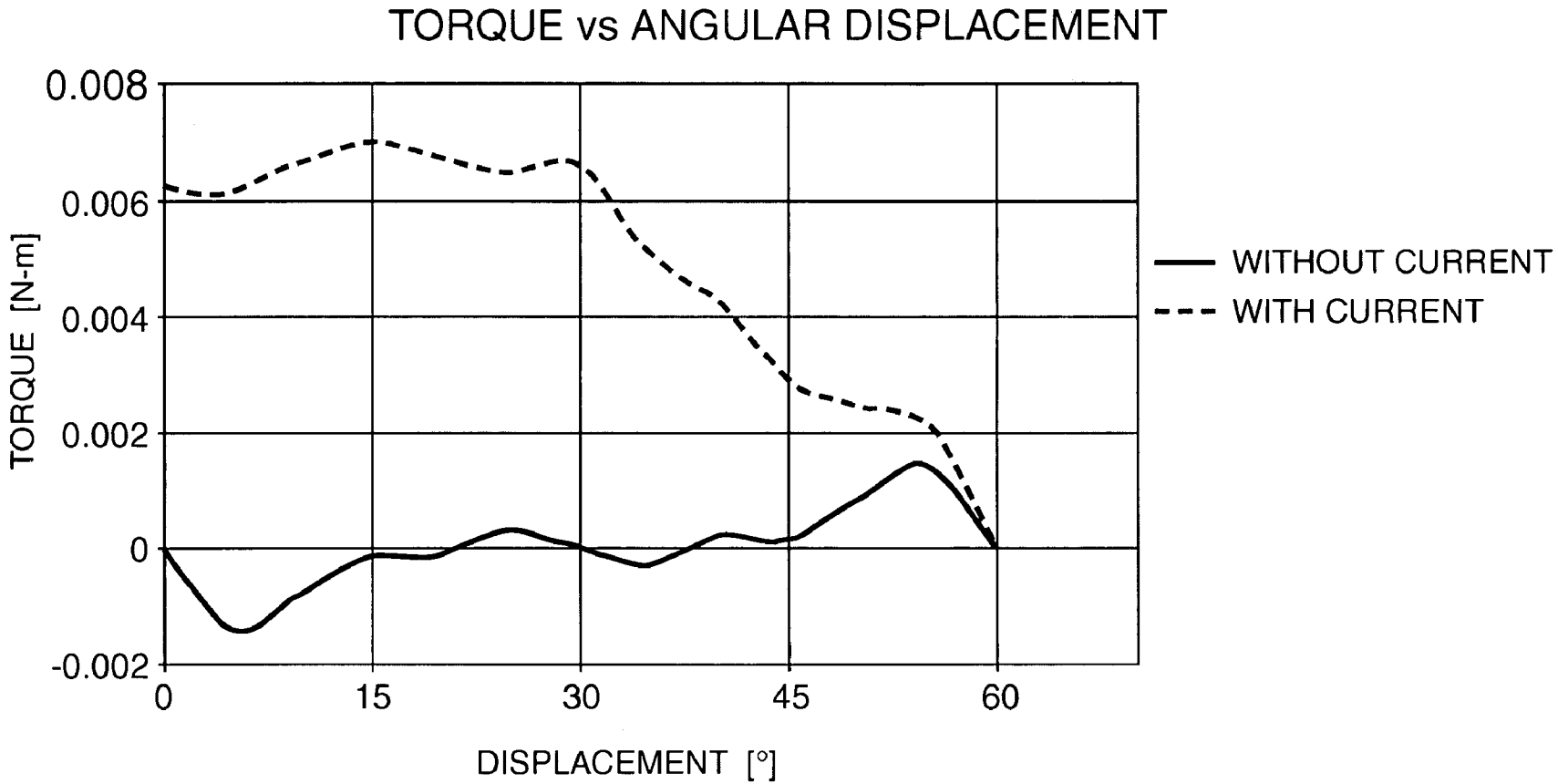
FIG. 6 is a graph showing the curve of torque versus angular displacement for the actuator of FIG. 1 with and without current.

FIG. 6 is a graph of the actuator torque versus angular displacement that illustrates the improved switching behavior of actuator 10 with and without current. Examination of the un-powered torque curve shows that there is very little parasitic torque caused by permanent magnet 16. A small restorative un-powered torque is allowed to remain at small displacements from the normal rest positions (i.e. 0° and 60°) to enhance stability of the selected positions. In a normal actuation operation of a microwave T-switch, the resisting load from the rf module is greatest at 10° and at 30°. In the presence of current, the torque properties illustrate that high torque is simultaneously achieved in both critical regions, such favorable properties being achieved by optimizing the dimensions of the maximum and the reduced radius regions of rotor pole regions 18 and 22.

Accordingly, actuator 10 provides efficient switching action to microwave T-switch 50 at a reduced actuator mass since the only magnetic material required is concentrated within a single permanent magnet 16. Also, actuator 10 exhibits improved switching behavior as illustrated by the associated optimized torque curves (FIG. 6) due to the fact that the stator poles associated with the stator pole shoes 20A, 20B, 20C, 20D, 20E, 20F of stator 12 are all of similar magnetic sense and since actuator 10 exploits the bilateral symmetry of the microwave T-switch as discussed. Further, the design of actuator 10 achieves the use of hybrid motor design for large angle steps (e.g. 60°) and for single phase on and single step actuation. Furthermore, the actuator stator poles all have similar magnetic sense that provides the symmetry necessary to achieve all anticipated actuation requirements with a single 60° step. In addition, the switching distance never exceeds 60° that ensures faster switching speeds. Finally, the use of "shaded pole" construction and the ability to adjust the area and the recess associated with reduced radius regions 18C, 18D, 18E, 18F, 22C, 22D, 22E, 22F to match the hybrid actuator torque curve to the load allows actuator 10 to utilize a hybrid motor for application in an rf switch.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. A hybrid switch actuator having six positions that are stable in the absence of current and in which displacement occurs between an initial position and a target position under the action of a current, for operation of a microwave switch, said actuator comprising:

(a) a stator having six pole shoes, each pair of opposed pole shoes being associated with a common exciting coil;

(b) a rotor package rotatable along a rotation axis and adapted to be positioned within said stator and having two pairs of rotor poles magnetized transversely in alternate directions, said rotor package including:

(i) a permanent magnet ring magnetized along the rotation axis;

(ii) two end caps adapted to be engaged around said permanent magnet ring, each end cap having two maximum radius regions that each correspond to the area of each of the stator pole shoes, each end cap also having four reduced radius regions, each maximum radius region having two of said four reduced radius regions positioned adjacent therein;

(c) wherein the difference between the radius of the maximum radius regions and the radius of the reduced radius regions is substantially smaller than the radial dimensions of the rotor package;

(d) such that when the actuator is in the initial position two diametrically opposed stator pole shoes having a first polarity are excited through their associated common exciting coil, said stator pole shoes attract two diametrically opposed rotor poles having an opposite polarity to said first polarity and repel the remaining two rotor poles, and the remaining two rotor poles are repelled from the stator pole shoes having a first polarity, and as the minimum radius regions adjacent to the maximum radius regions of the diametrically opposed rotor poles overlap the stator pole shoes having a first polarity, a reduction of the reluctance gap therebetween occurs and then as the maximum radius regions of the diametrically opposed rotor poles overlap the stator pole shoes having a first polarity a further reduction of the reluctance gap therebetween occurs until each rotor pole associated with a maximum radius region is aligned with a stator pole associated with a stator pole shoe of the actuator in the target position.

2. The actuator of claim 1, wherein said end caps are separated from each other by at least 1.5 mm.

3. The actuator of claim 1, wherein rotor package is adapted to move from any initial position to any target position by moving 60 degrees.

4. The actuator of claim 1 in combination with a T-switch having an if module, wherein said maximum radius regions and said minimum radius regions are dimensioned so that in the presence of current, high torque is achieved when the resisting load from the rf module is greatest.

5. The actuator of claim 1, wherein the difference between the radius of the maximum radius region and the radius of the reduced radius region is in the range of 0.5% to 2.2% of the radius of the permanent magnet.

6. The actuator of claim 1, wherein the difference between the radius of the maximum radius region and the radius of the reduced radius region is in the range of 0.416% to 2.5% of the thickness of the permanent magnet.

7. The actuator of claim 1, wherein each pair of opposed stator pole shoes are of like polarity.

8. The actuator of claim 1, wherein each pair of opposed rotor poles are of like polarity.

* * * * *

UNITED STATES PATENT AND TRADEMARK OFFICE

CERTIFICATE OF CORRECTION

PATENT NO. : 7,135,947 B2
APPLICATION NO. : 10/765944
DATED : November 14, 2006
INVENTOR(S) : Klaus Gunter Engel It is certified that error appears in the above-identified patent and that said Letters Patent is hereby corrected as shown below:

Column 10, line 2, replace “having an if module” with --having an rf module--

Signed and Sealed this

Tenth Day of April, 2007

JON W. DUDAS
*Director of the United States Patent and Trademark Office*

UNITED STATES PATENT AND TRADEMARK OFFICE

CERTIFICATE OF CORRECTION

PATENT NO. : 7,135,947 B2
APPLICATION NO. : 10/765944
DATED : November 14, 2006
INVENTOR(S) : Klaus Gunter Engel It is certified that error appears in the above-identified patent and that said Letters Patent is hereby corrected as shown below:

Column 9, in Claim 1:
Line 6, "the minimum radius" should be -- the reduced radius --.

Column 10, in Claim 3:
Line 3, "said minimum radius" should be -- said reduced radius --.

Signed and Sealed this

Sixth Day of July, 2010

David J. Kappos

David J. Kappos
*Director of the United States Patent and Trademark Office*